US011085447B2

(12) United States Patent
Hebrard et al.

(10) Patent No.: US 11,085,447 B2
(45) Date of Patent: Aug. 10, 2021

(54) SCREW COMPRESSOR FOR A UTILITY VEHICLE

(71) Applicant: KNORR-BREMSE Systeme fuer Nutzfahrzeuge GmbH, Munich (DE)

(72) Inventors: Gilles Hebrard, Munich (DE); Jean-Baptiste Marescot, Munich (DE); Joerg Mellar, Munich (DE); Thomas Weinhold, Munich (DE); Engelbert Koeck, Munich (DE)

(73) Assignee: KNORR-BREMSE Systeme fuer Nutzfahrzeuge GmbH, Munich (DE)

( * ) Notice: Subject to any disclaimer, the term of this patent is extended or adjusted under 35 U.S.C. 154(b) by 228 days.

(21) Appl. No.: 16/331,267

(22) PCT Filed: Sep. 19, 2017

(86) PCT No.: PCT/EP2017/073539
§ 371 (c)(1),
(2) Date: Apr. 18, 2019

(87) PCT Pub. No.: WO2018/054857
PCT Pub. Date: Mar. 29, 2018

(65) Prior Publication Data

US 2020/0040897 A1 Feb. 6, 2020

(30) Foreign Application Priority Data

Sep. 21, 2016 (DE) ..... 10 2016 011 437.1

(51) Int. Cl.
*F04C 28/06* (2006.01)
*F04C 18/16* (2006.01)
(Continued)

(52) U.S. Cl.
CPC ..... *F04C 28/06* (2013.01); *F04C 18/16* (2013.01); *F04C 28/24* (2013.01); *F04C 28/28* (2013.01);
(Continued)

(58) Field of Classification Search
CPC ..... F04C 18/16; F04C 29/026; F04C 28/06; F04C 2240/30; F04C 2270/19; F04C 28/24; F04C 28/28; F04C 29/02; F04C 29/04
See application file for complete search history.

(56) References Cited

U.S. PATENT DOCUMENTS 4,492,526 A * 1/1985 Hartwig ..... G05D 16/2066 417/45
4,968,218 A * 11/1990 Koivula ..... F04C 28/24 416/19
(Continued)

FOREIGN PATENT DOCUMENTS

AT 401 551 B 10/1996
DE 10 2004 060 417 B4 10/2006
(Continued)

OTHER PUBLICATIONS

Korean-language Office Action issued in Korean Application No. 10-2019-7010549 dated May 1, 2020 with English translation (10 pages).
(Continued)

*Primary Examiner* — Peter J Bertheaud
(74) *Attorney, Agent, or Firm* — Crowell & Moring LLP

(57) ABSTRACT

A screw compressor system for a utility vehicle includes at least one screw compressor and at least one control and/or regulation unit for controlling and regulating the screw compressor. The control and/or regulation unit is designed
(Continued)

such that the screw compressor is prevented, for a determined period of time, from re-starting after being stopped.

7 Claims, 2 Drawing Sheets

(51) Int. Cl.
*F04C 28/28* (2006.01)
*F04C 28/24* (2006.01)
*F04C 29/02* (2006.01)

(52) U.S. Cl.
CPC ..... *F04C 29/026* (2013.01); *F04C 2270/80* (2013.01)

(56) References Cited

U.S. PATENT DOCUMENTS

| | | | | |
|---|---|---|---|---|
| 5,584,673 | A | 12/1996 | Rein | |
| 2003/0194330 | A1 | 10/2003 | Lifson | |
| 2008/0044307 | A1 | 2/2008 | Koeck | |
| 2009/0041589 | A1 | 2/2009 | Liebert et al. | |
| 2009/0232687 | A1 | 9/2009 | Tanaka et al. | |
| 2010/0028165 | A1 | 2/2010 | Kameya et al. | |
| 2012/0315151 | A1 | 12/2012 | Hamdan | |
| 2012/0316713 | A1 | 12/2012 | Pfefferl et al. | |
| 2015/0176575 | A1* | 6/2015 | Nemeth | B60T 17/02 417/34 |
| 2017/0067465 | A1 | 3/2017 | Oshiro | |

FOREIGN PATENT DOCUMENTS

| | | | |
|---|---|---|---|
| JP | 8-93675 | A | 4/1996 |
| JP | 2009-216000 | A | 9/2009 |
| JP | 2010-31814 | A | 2/2010 |
| KR | 10-2007-0110539 | A | 11/2007 |
| KR | 10-2016-0058838 | A | 5/2016 |
| WO | WO 2005/035989 | A1 | 4/2005 |
| WO | WO 2012/170094 | A2 | 12/2012 |
| WO | WO 2015/035478 | A1 | 3/2015 |

OTHER PUBLICATIONS

International Preliminary Report on Patentability (PCT/IB/326 & PCT/IB/373) issued in PCT Application No. PCT/EP2017/073539 dated Apr. 4, 2019, including English translation of document C2 (German-language Written Opinion (PCT/ISA/237) previously filed on Mar. 7, 2019) (seven (7) pages).

Japanese-language Office Action issued in Japanese Application No. 2019-536666 dated May 28, 2020 with English translation (six (6) pages).

Chinese-language Office Action issued in counterpart Chinese Application No. 201780058085.0 dated Dec. 2, 2019 with partial English translation (seven (7) pages).

International Search Report (PCT/ISA/210) issued in PCT Application No. PCT/EP2017/073539 dated Dec. 18, 2017 with English translation (four (4) pages).

German-language Written Opinion (PCT/ISA/237) issued in PCT Application No. PCT/EP2017/073539 dated Dec. 18, 2017 (five (5) pages).

German-language Office Action issued in counterpart German Application No. 10 2016 011 437.1 dated Oct. 17, 2017 with English translation (four (4) pages).

Japanese-language Office Action issued in Japanese Application No. 2019-536666 dated Jan. 6, 2021 with English translation (seven (7) pages).

* cited by examiner

SCREW COMPRESSOR FOR A UTILITY VEHICLE

BACKGROUND AND SUMMARY OF THE INVENTION

The present invention relates to a screw compressor system for a utility vehicle, having at least one screw compressor and having at least one open-loop and/or closed-loop control unit for the open-loop and/or closed-loop drive control of the screw compressor.

Screw compressors for utility vehicles are already known from the prior art. Such screw compressors are used to provide the compressed air required for the brake system of the utility vehicle, for example.

However, the compressed-air demand for the brake system fluctuates in accordance with the operating state of the utility vehicle, such that the screw compressor cyclically stops and starts up again in response to this.

If an operating state of the utility vehicle requires a start-up of the screw compressor shortly after a stoppage of the latter, an elevated pressure has already formed in the screw compressor in the short time after the stoppage of the screw compressor. Charging of the screw chamber with elevated pressure occurs because the working pressure prevails as before at the outlet of the screw chamber when the screws are at a standstill, whereas substantially the atmospheric pressure prevails at the inlet of the screw chamber, such that the air flows back counter to the conveying direction to the suction side and builds up pressure there.

If the screw compressor is started up again under the circumstances described above, said screw compressor compresses air not proceeding from the atmospheric pressure but proceeding from the elevated pressure level described above.

This undesired operating state gives rise to brief pressure peaks within the screw compressor and to brief additional loading of the corresponding drive, and should therefore be prevented as far as possible.

DE 10 2004 060 417 B4 has already disclosed a generic screw compressor.

It is the object of the present invention to advantageously further develop a screw compressor system of the type mentioned in the introduction, in particular such that the so-called charging effect in the screw compressor is prevented and a generation of a positive pressure in the screw compressor can be reliably prevented.

This object is achieved according to the invention by a screw compressor system for a utility vehicle to be equipped with at least one screw compressor and with at least one open-loop and/or closed-loop control unit for the open-loop and/or closed-loop drive control of the screw compressor. The open-loop and/or closed-loop control unit is configured such that the screw compressor is, after a stoppage, prevented from restarting for a predetermined time period.

The invention is based on the underlying concept that the screw compressor has a release valve by which, after a stoppage of the screw compressor, the pressure in the screw compressor can be dissipated. By preventing the restart of the screw compressor directly after a stoppage of the screw compressor for a predetermined time period, it is ensured that the pressure in the screw compressor can be dissipated in any case. If this is not the case, the so-called charging effect can arise, that is to say the compressed air at working pressure flows upstream into the screw chamber through the outlet thereof and prevails at the air inlet and at the inlet to the screws of the screw compressor, such that said pressure is built up yet further as a result of the restart of the screw compressor. In this case, a very high drive torque is generated, which, in the case of an electrical screw compressor drive, is manifest as an elevated start-up current, and would lead to overloading of the electric motor. This undesired operating state should be reliably prevented. This operating state can be prevented by awaiting, in any case, the expiry of a predetermined time period, within which the pressure in the screw compressor is dissipated.

For example, provision may be made for the open-loop and/or closed-loop control unit to be a constituent part of the screw compressor. In this way, a compact construction is formed, and it is not necessary to resort to external components.

It is however basically also contemplated for the open-loop and/or closed-loop control unit to be a constituent part of an air treatment system of the utility vehicle. Here, a corresponding controller is already provided, which can easily be jointly utilized.

It is also contemplated for the open-loop and/or closed-loop control unit to be a constituent part of an engine or vehicle controller of the utility vehicle. Here, too, it would be possible to resort to an existing component of the utility vehicle.

It is however basically also contemplated for the open-loop and/or closed-loop control unit to be in the form of a separate open-loop and/or closed-loop control unit. This permits, for example, easy installation and also an easy exchange or easy upgrade.

It is contemplated for the time period to amount to at least approximately 10 seconds, in particular at least approximately 15 seconds. In the case of conventional relief valves, such a time period is sufficient to achieve a reliable lowering of the working pressure or prevailing pressure in the screw compressor to a pressure level at which no detrimentally high backflow pressure prevails in the screw chamber.

Furthermore, provision may be made for the screw compressor to have at least one relief valve. By means of this relief valve, the pressure in the screw compressor can be easily and reliably dissipated.

The relief valve is dimensioned such that the interior of the screw compressor can, within the predetermined time period, be relieved of pressure to a pressure which is close to atmospheric pressure or which is approximately atmospheric pressure. In this way, reliable operation of the screw compressor is made possible, and the so-called charging effect is reliably prevented.

Further details and advantages of the invention will now be discussed in more detail on the basis of an exemplary embodiment illustrated in the drawings.

DETAILED DESCRIPTION OF THE DRAWINGS

Figure 1:
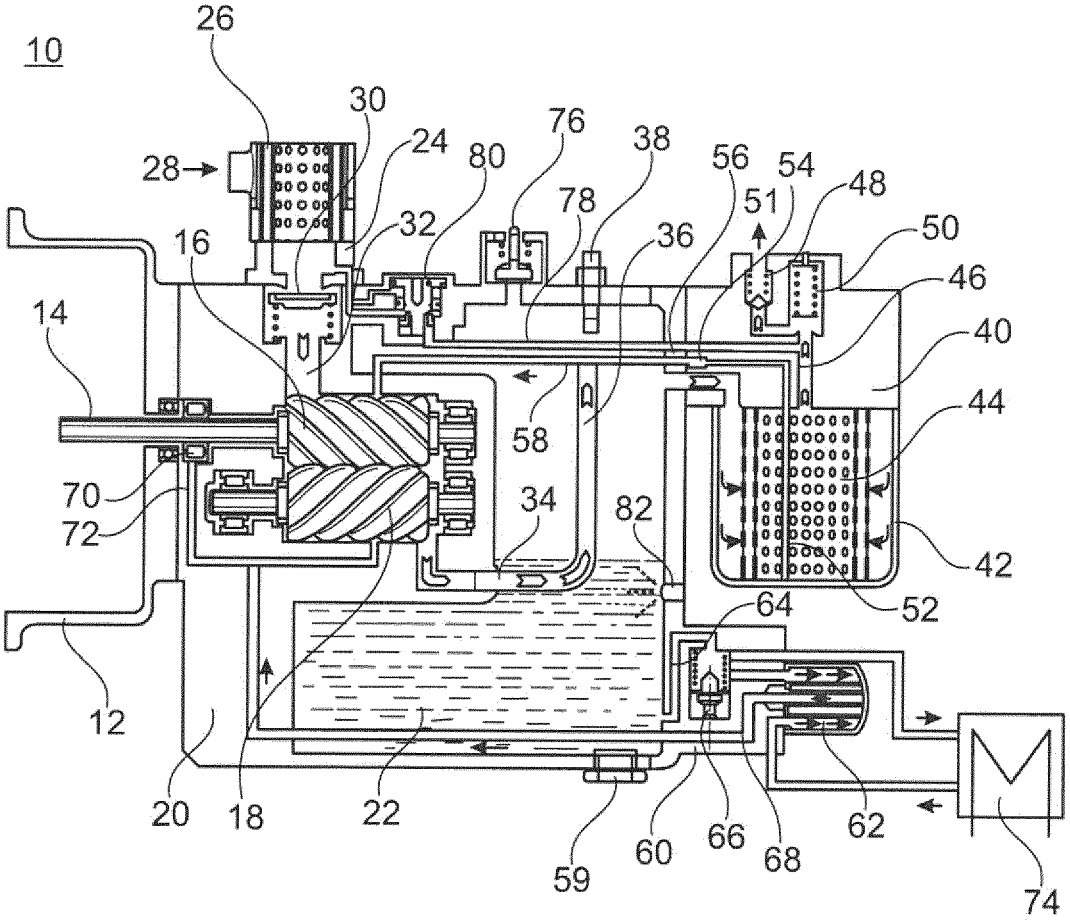
FIG. 1 shows a schematic sectional drawing through a screw compressor according to the invention.

FIG. 1 shows, in a schematic sectional illustration, a screw compressor 10 in the context of an exemplary embodiment of the present invention.

The screw compressor 10 has a fastening flange 12 for the mechanical fastening of the screw compressor 10 to a drive (not shown in any more detail here) in the form of an electric motor.

What is shown, however, is the input shaft 14, by which the torque from the electric motor is transmitted to one of the two screws 16 and 18, specifically the screw 16.

The screw 18 meshes with the screw 16 and is driven by means of the latter.

The screw compressor 10 has a housing 20 in which the main components of the screw compressor 10 are accommodated.

The housing 20 is filled with oil 22.

At the air inlet side, an inlet connector 24 is provided on the housing 20 of the screw compressor 10. The inlet connector 24 is in this case designed such that an air filter 26 is arranged at said inlet connector. Furthermore, an air inlet 28 is provided radially on the air inlet connector 24.

In the region between the inlet connector 24 and the point at which the inlet connector 24 joins to the housing 20, there is provided a spring-loaded valve insert 30, which is designed here as an axial seal.

The valve insert 30 serves as a check valve.

Downstream of the valve insert 30, there is provided an air feed channel 32 which feeds the air to the two screws 16, 18.

At the outlet side of the two screws 16, 18, there is provided an air outlet pipe 34 with a riser line 36.

In the region of the end of the riser line 36, there is provided a temperature sensor 38 by which the oil temperature can be monitored.

Also provided in the air outlet region is a holder 40 for an air deoiling element 42.

In the assembled state, the holder 40 for the air deoiling element has the air deoiling element 42 in the region facing toward the base (as also shown in FIG. 1).

Also provided, in the interior of the air deoiling element 42, is a corresponding filter screen or known filter and oil separating devices 44, which will not be specified in any more detail.

In the central upper region in relation to the assembled and operationally ready state (that is to say as shown in FIG. 1), the holder for the air deoiling element 42 has an air outlet opening 46 which leads to a check valve 48 and a minimum pressure valve 50. The check valve 48 and the minimum pressure valve 50 may also be formed in one common combined valve.

The air outlet 51 is provided downstream of the check valve 48.

The air outlet 51 is generally connected to correspondingly known compressed-air consumers.

In order for the oil 22 that is situated and separated off in the air deoiling element 42 to be returned again into the housing 20, a riser line 52 is provided which has a filter and check valve 54 at the outlet of the holder 40 for the air deoiling element 42 at the transition into the housing 20.

A nozzle 56 is provided, downstream of the filter and check valve 54, in a housing bore. The oil return line 58 leads back into approximately the central region of the screw 16 or of the screw 18 in order to feed oil 22 thereto again.

An oil drain screw 59 is provided within the base region, in the assembled state, of the housing 20. By means of the oil drain screw 59, a corresponding oil outflow opening can be opened, via which the oil 22 can be drained.

Also provided in the lower region of the housing 20 is the attachment piece 60 to which the oil filter 62 is fastened. Via an oil filter inlet channel 64, which is arranged in the housing 20, the oil 22 is conducted firstly to a thermostat valve 66.

Instead of the thermostat valve 66, it is possible for an open-loop and/or closed-loop control device to be provided by means of which the oil temperature of the oil 22 situated in the housing 20 can be monitored and set to a setpoint value.

Downstream of the thermostat valve 66, there is then the oil inlet of the oil filter 62, which, via a central return line 68, conducts the oil 22 back to the screw 18 or to the screw 16 again, and also to the oil-lubricated bearing 70 of the shaft 14. Also provided in the region of the bearing 70 is a nozzle 72, which is provided in the housing 20 in conjunction with the return line 68.

The cooler 74 is connected to the attachment piece 60.

In the upper region of the housing 20 (in relation to the assembled state), there is situated a safety valve 76, by which an excessively high pressure in the housing 20 can be dissipated.

Upstream of the minimum pressure valve 50, there is situated a bypass line 78, which leads to a relief valve 80. Via said relief valve 80, which is activated by a connection to the air feed 32, air can be returned into the region of the air inlet 28. In this region, there may be provided a ventilation valve (not shown in any more detail) and also a nozzle (diameter constriction of the feeding line).

Furthermore, approximately at the level of the line 34, an oil level sensor 82 may be provided in the outer wall of the housing 20. Said oil level sensor 82 may for example be an optical sensor, and may be designed and configured such that, on the basis of the sensor signal, it can be identified whether the oil level during operation is above the oil level sensor 82 or whether the oil level sensor 82 is exposed, and thus the oil level has correspondingly fallen.

In conjunction with this monitoring, it is also possible for an alarm unit to be provided which outputs or transmits a corresponding error message or warning message to the user of the system.

The function of the screw compressor 10 shown in FIG. 1 is as follows.

Air is fed via the air inlet 28 and passes via the check valve 30 to the screws 16, 18, where the air is compressed. The compressed air-oil mixture, which, having been compressed by a factor of between 5 and 16 downstream of the screws 16 and 18, rises through the outlet line 34 via the riser pipe 36, is blown directly onto the temperature sensor 38.

The air, which still partially carries oil particles, is then conducted via the holder 40 into the air deoiling element 42 and, if the corresponding minimum pressure is attained, passes into the air outlet line 51.

The oil 22 situated in the housing 20 is kept at operating temperature via the oil filter 62 and possibly via the heat exchanger 74.

If no cooling is necessary, the heat exchanger 74 is not used and is also not activated.

The corresponding activation is performed by the thermostat valve 66. After purification in the oil filter 62, oil is fed via the line 68 to the screw 18 or to the screw 16, and also to the bearing 70. The screw 16 or the screw 18 is supplied with oil 22 via the return line 52, 58, and the purification of the oil 22 takes place here in the air deoiling element 42.

By means of the electric motor (not shown in any more detail), which transmits its torque via the shaft 14 to the screw 16, which in turn meshes with the screw 18, the screws 16 and 18 of the screw compressor 10 are driven.

By means of the relief valve 80 (not shown in any more detail), it is ensured that the high pressure that prevails for example at the outlet side of the screws 16, 18 in the operational state cannot be enclosed in the region of the feed line 32, and that, instead, in particular during the start-up of the compressor, there is always a low inlet pressure, in particular atmospheric pressure, prevailing in the region of the feed line 32. Otherwise, upon a start-up of the compressor, a very high pressure would initially be generated at the outlet side of the screws 16 and 18, which would overload the drive motor.

Figure 2:
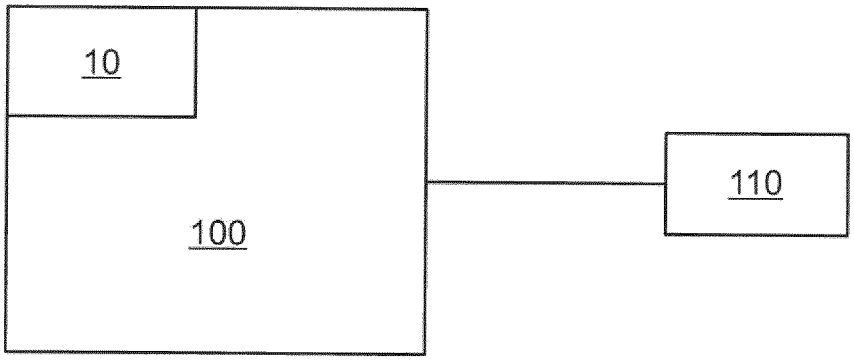
FIG. 2 shows a schematic drawing of the screw compressor system according to the present invention.

FIG. 2 shows, in a schematic view, the screw compressor system 100 according to the invention, having the screw compressor 10 shown in FIG. 1 and having a control unit 110.

Here, the control unit 110 is formed as an open-loop and closed-loop control unit of the screw compressor 10 or as a constituent part of the screw compressor 10.

Provision may however basically be made for the open-loop and/or closed-loop control unit 110 to be configured as a constituent part of an air treatment system (EAC) of the utility vehicle, as a constituent part of an engine controller of the utility vehicle, as a constituent part of a vehicle controller of the utility vehicle, or as a separate open-loop and/or closed-loop control unit 110.

By means of the open-loop and closed-loop control unit 110, it is ensured that, after a stoppage of the screw compressor 10 or of the drive of the screw compressor 10, a restart of the screws 16, 18 is prevented for a predetermined time period.

This time period amounts, in the exemplary embodiment shown, to approximately 10 seconds, though may also lie in the range between 10 and 15 seconds, or else may be longer.

By means of the relief valve 80, the working pressure prevailing in the screw compressor 10 can, within the predetermined time period, be dissipated to such an extent that the so-called charging effect is in any case reliably prevented. This charging effect arises in particular by virtue of the fact that the working pressure that prevails behind or downstream of the screws 16, 18 directly after the stoppage of the screw compressor 10 can pass upstream, both via the outlet of the screw chamber and via the corresponding lines 58, 68, into the intake region of the screws 16, 18, that is to say into the air inlet 32. If a restart of the screws 16, 18 then occurs before a pressure dissipation has taken place, the pressure prevailing there is compressed by the screws 16, 18, such that an undesired operating state may arise in which the working pressure could be compressed yet further, for example by a factor of ten.

The relief valve 80 is in this case dimensioned such that the interior of the screw compressor 10 can, within the predetermined time period, be relieved of pressure to a pressure which is close to atmospheric pressure or which is approximately atmospheric pressure.

LIST OF REFERENCE DESIGNATIONS

10 Screw compressor
12 Fastening flange
14 Input shaft
16 Screws
18 Screws
20 Housing
22 Oil
24 Inlet connector
26 Air filter
28 Air inlet
30 Valve insert
32 Air feed channel
34 Air outlet pipe
36 Riser line
38 Temperature sensor
40 Holder for an air deoiling element
42 Air deoiling element
44 Filter screen or known filter or oil separation devices
46 Air outlet opening
48 Check valve
50 Minimum pressure valve
51 Air outlet
52 Riser line
54 Filter and check valve
56 Nozzle
58 Oil return line
59 Oil drain screw
60 Attachment piece
62 Oil filter
64 Oil filter inlet channel
66 Thermostat valve
68 Return line
70 Bearing
72 Nozzle
74 Cooler, heat exchanger
76 Safety valve
78 Bypass line
80 Relief valve
82 Oil level sensor
100 Screw compressor system
110 Control unit

What is claimed is:

1. A screw compressor system for a utility vehicle, comprising:

at least one screw compressor;

an open-loop and/or closed-loop control unit for open-loop and/or closed-loop drive control of the screw compressor, wherein the open-loop and/or closed-loop control unit is configured such that the screw compressor is, after a stoppage, prevented from restarting for a predetermined time period;

at least one relief valve, wherein the relief valve is dimensioned such that an interior of the screw compressor can, within the time period, be relieved of pressure to a pressure which is close to atmospheric pressure or which is approximately atmospheric pressure; and a minimum pressure valve, a bypass line, an air feed, and an air inlet, wherein the bypass line is disposed upstream of the minimum pressure valve and the bypass line leads to the relief valve, wherein air can be returned into a region of the air inlet via the relief valve, which is activated by a connection to the air feed.

2. The screw compressor system as claimed in claim 1, wherein the open-loop and/or closed-loop control unit is a constituent part of the screw compressor.

3. The screw compressor system as claimed in claim 1, wherein the open-loop and/or closed-loop control unit is a constituent part of a drive of an air treatment system of the utility vehicle.

4. The screw compressor system as claimed in claim 1, wherein the open-loop and/or closed-loop control unit is a constituent part of an engine or vehicle controller of the utility vehicle.

5. The screw compressor system as claimed in claim 1, wherein the open-loop and/or closed-loop control unit is in a form of a separate open-loop and/or closed-loop control unit.

6. The screw compressor system as claimed in claim 1, wherein the time period amounts to at least approximately 10 seconds.

7. The screw compressor system as claimed in claim 1, wherein the time period amounts to at least approximately 15 seconds.

* * * * *